United States Patent [19]

Tsui

[11] 4,283,879

[45] Aug. 18, 1981

[54] TOY VEHICLE WITH FOUR-WHEEL DRIVE

[75] Inventor: Kwok W. Tsui, Wanchai, Hong Kong

[73] Assignee: Arco Industries Ltd., Kowloon, Hong Kong

[21] Appl. No.: 143,852

[22] Filed: Apr. 25, 1980

[51] Int. Cl.[3] ..... A63H 29/20; A63H 17/00

[52] U.S. Cl. ..... 46/209; 46/206

[58] Field of Search ..... 46/206, 209, 251, 202

[56] References Cited

U.S. PATENT DOCUMENTS

| | | | |
|---|---|---|---|
| 1,087,277 | 2/1914 | Clark | 46/209 |
| 2,873,553 | 2/1959 | Ullman | 46/209 |
| 3,074,201 | 1/1963 | Fileger | 46/251 |
| 3,540,151 | 11/1970 | Ishida | 46/202 |
| 3,849,931 | 11/1974 | Gulley, Jr. | 46/206 |
| 3,955,429 | 5/1976 | Holden | 46/209 |
| 4,116,084 | 9/1978 | Masuda | 46/209 |
| 4,130,963 | 12/1978 | Ohashi | 46/209 |

*Primary Examiner*—Gene Mancene
*Assistant Examiner*—Michael J. Foycik, Jr.
*Attorney, Agent, or Firm*—C. Hercus Just

[57] ABSTRACT

A toy vehicle having a chassis supporting a pair of parallel spaced axles with wheels fixed to the outer ends thereof, a motor connected to said axles including an inertia flywheel on a shaft and gear trains extending respectively between the shaft and the axles in a manner for both axles to be driven unidirectionally simultaneously to provide a four-wheel drive, in combination with gear throw-out safety mechanism operable to remove one gear of each train from driving engagement with the trains when any of the wheels are stopped while the flywheel is still rotating and thereby prevent damage to the gear trains.

2 Claims, 3 Drawing Figures

TOY VEHICLE WITH FOUR-WHEEL DRIVE

BACKGROUND OF THE INVENTION

Toy vehicles of various kinds have been popular with children for many generations and in recent years, relatively small-sized four-wheel vehicles have become popular which require no winding of motors or the like to power them but instead, employ inertia-type flywheels, which are energized by pushing the vehicle along a surface, such as a floor or table, rapidly a number of times to get the flywheel rotating at high speed and the weight thereof is sufficient to effect movement of the vehicle for substantial distances during various periods of time. For the most part, vehicles of this type are powered by a single axle and typical examples of such vehicles comprise the subject matter of prior U.S. Pat. Nos. 2,873,553 to Ullman, dated Feb. 17, 1959, and 3,955,429, to Holden, dated May 11, 1976.

To render vehicles of this type more versatile, and especially to have greater climbing power to ascend, for example, inclined surfaces, such as a ramp, simulated bridge, or the like, it has been found that if both axles of four-wheeled vehicles are powered, they are able to ascend such inclined surfaces, whereas when only a single axle is powered, it is difficult, if at all possible, for the vehicle to ascend or climb such inclined surfaces.

Toy vehicles of various kinds in which two or more axles are powered are not new and typical examples of this type of toy comprise the subject matter of prior U.S. Pat. Nos. 1,087,277 to Clark, dated Feb. 17, 1914; 3,540,151 to Ishida, dated Nov. 17, 1970; and 3,849,931 to Gulley, Jr., dated Nov. 26, 1974. The types of toys shown in said aforementioned patents are relatively sophisticated, and of the three, only the patent to Clark employs an inertia flywheel to supply the driving force for both axles of the vehicle. However, the nature of the Clark device is such that when one end of the vehicle, which appears to be an electrical locomotive, hits an abutment, such as a wall or article of furniture, the motor is shifted to reverse the direction of movement of the wheels, and this occurs each time either end of the vehicle hits an abutting surface, as long as the device is driven by rotation of the inertia flywheel. Obviously, the reversibility of movement requires considerable mechanism, which is not required in a toy vehicle adapted, for example, for a single direction only without reversibility, and it is this type of toy vehicle that the present invention provides, details of which are set forth below:

SUMMARY OF THE INVENTION

It is the principal object of the present invention to provide a relatively simple motor unit for a toy vehicle having a pair of axles to which similar wheels are fixed on the opposite ends thereof, the motor being energized by an inertia flywheel of appreciable weight and connected by relatively simple gear trains respectively to the pair of axles for unidirectional rotation thereof to drive the vehicle forward only.

It is another object of the present invention to include with the motor, comprising the inertia flywheel and gear train, safety means which will throw out or dislodge one of the gears of each train in the event any of the wheels are stopped, such as by the vehicle hitting an obstruction, as well as when, for example, doing the energizing of the inertia flywheel by numerous contacts of the wheels with a floor or other surface and pushing the same forwardly a number of times, it is obvious that each time the wheels initially contact such surface, there is a usual tendency to stop rotation of the wheels for an instant before pushing the vehicle forwardly, whereby during any of such situations, there is a possibility that continued rotation of the inertia flywheel while the vehicle wheels are stopped, will cause injury, at least to certain portions of the gear train, and it is the purpose of the present invention to prevent this.

A further object of the invention ancillary to the foregoing objects is to provide such throw-out mechanism for one gear in each train in the form of a pair of slots respectively formed in opposite side frame plates of the motor, through which the ends of the shaft for said throw-out gear extends, whereby when the ends of the shaft are at one end of said slots, the gear thereon will be in operative mesh with the other gears of the train thereof, but when the ends of the shaft are in the opposite end of the slots, the gear thereon will be out of driving engagement with the gears of the train, even though possibly contacting one of said gears while not meshing with another gear with which it normally meshes when in operative arrangement.

Still another object of the invention pertinent to the immediate foregoing object is to provide spring means engageable with said ends of the shaft upon which said throw-out gear is mounted, said spring means normally tending to maintain the shaft in the end of the slot in which the gear thereon is in driving engagement with its gear train, while stopping of the wheels of the vehicle will instantly cause the throw-out gear to dislodge itself from normal driving relationship by means of the ends of its shaft moving to the opposite ends of the slots in the frame plates against the action of the springs associated therewith and which are capable of yielding to permit such movement of the ends of said shaft and dislodge or disengage the throw-out gear from its normal driving relationship with its train.

Details of the foregoing objects and of the invention, as well as other objects thereof, are set forth in the following specification and illustrated in the accompanying drawings comprising a part thereof:

DETAILED DESCRIPTION OF THE PREFERRED EMBODIMENT

Figure 1:
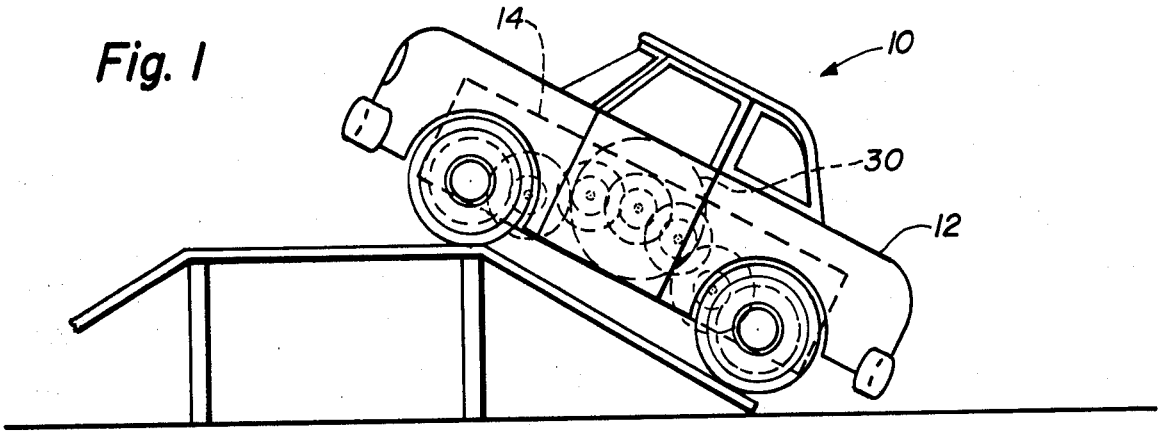
FIG. 1 is a side elevation of an exemplary arrangement of a toy vehicle embodying the principles of the present invention in process of ascending an upwardly sloping surface of substantial rise, which is easily negotiated by the vehicle in view of all four wheels thereof being powered.

In view of the popularity, especially of relatively small vehicles of the type shown in FIG. 1, certain examples of which are of the order of several inches in width and about four inches in length, it is possible to construct a chassis adapted to have many different styles of bodies thereon, and thus increase the popularity of this type of vehicle, especially when the body styles closely resemble actual full-scale vehicles. In order that wide sales of such vehicles may be enjoyed, however, it is one objective of the present invention to provide a motor which is relatively simple and inexpensive to produce but includes safety features, which minimize the possibility of damage to the motor, especially when the wheels are brought to a stop while the inertia flywheel of the motor still revolves. Details of such motor will now be described.

Figure 2:
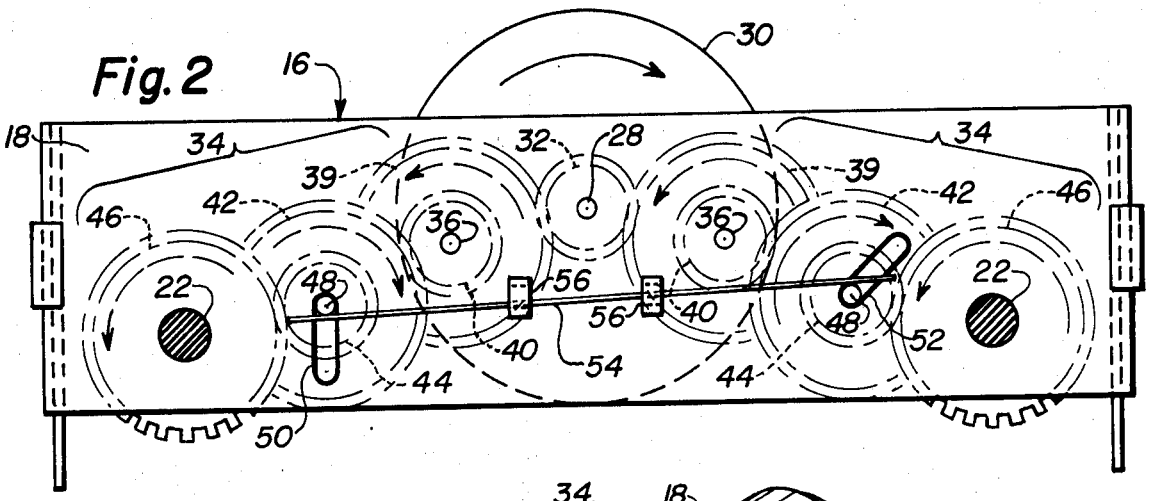
FIG. 2 is a somewhat diagrammatic side elevation of a motor embodying the principles of the present invention and the type included in the vehicle shown in FIG. 1.
Figure 3:
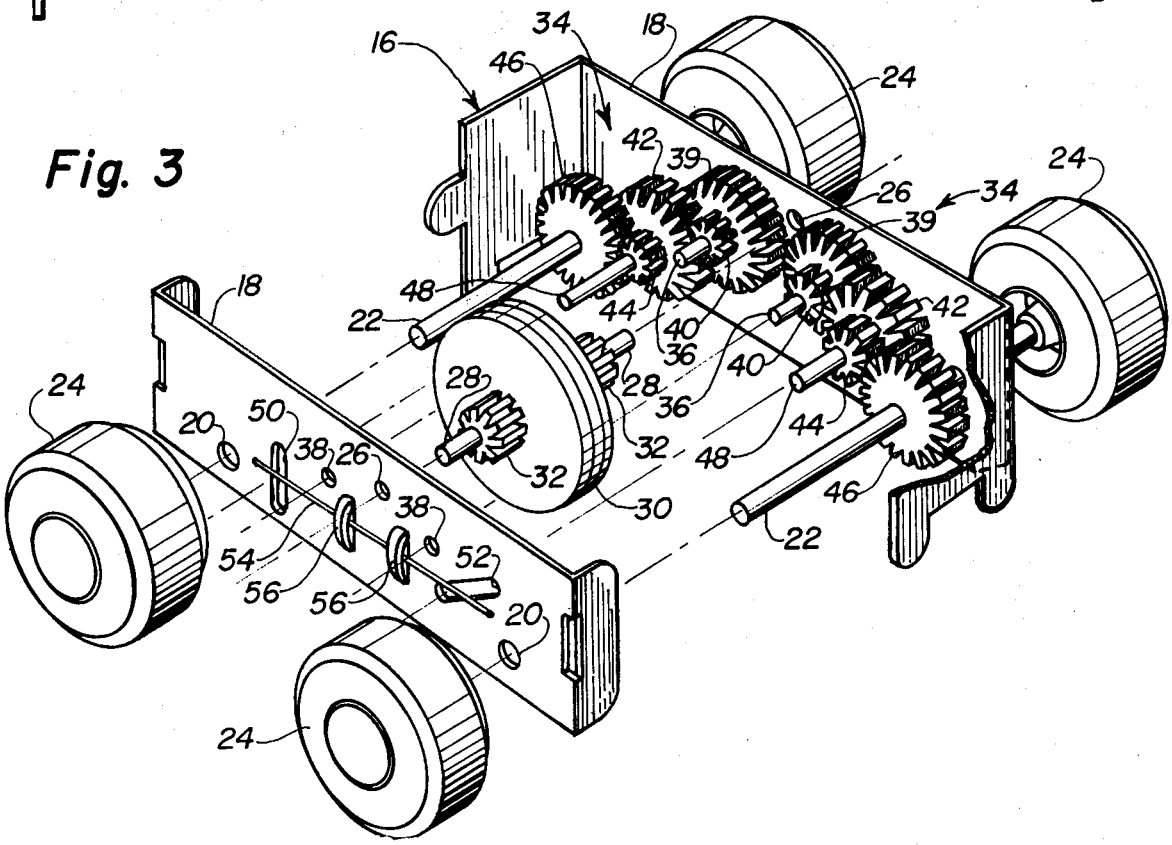
FIG. 3 is an exploded view of the motor shown in FIG. 2, better to illustrate the details thereof and only one set of pairs of gear trains being shown therein, it being understood that another set of a pair of trains similar thereto is included on the opposite side of the inertia flywheel illustrated centrally in said figure.

As shown in FIG. 1, the exemplary vehicle 10 comprises a body 12 of hollow nature within which the exemplary motor 14 is enclosed. Referring to FIGS. 2 and 3, it will be seen that the motor 14 has a substantially rectangular sheet metal frame 16 provided with parallel opposite sides 18 within which transversely aligned pairs of holes 20 are formed of larger diameter than additional pairs of transversely aligned holes of smaller diameter described in detail below. The holes 20 actually are bearing openings through which a pair of parallel axles 22 extend rotatably, the opposite ends projecting outwardly beyond the sides 18 for purposes of having similar wheels 24 fixedly attached thereto so as to be driven by said axles.

Midway of the sides 18, they are provided with additional bearing holes 26 in transverse alignment with each other for purposes of receiving opposite ends of the shaft 28 upon which the inertia flywheel 30 is fixedly mounted, said flywheel being of substantial weight and centrifugally balanced, the same also being provided with a driving pinion 32, respectively on opposite sides thereof. As shown in FIG. 3, only one set of a pair of gear trains 34 are illustrated but it is to be understood that in preferred construction, especially for balancing the operation of the motor for maximum efficiency of operation of the safety means described hereinafter, a second similar set comprising a pair of similar gear trains also are mounted between the flywheel 30 and the near side plate 18 of the motor, but said second set being omitted for purposes of simplicity.

Each of the gear trains 34, especially as viewed in FIG. 2 respectively are left-hand and right-hand, and each includes similar additional shafts 36, shown in FIGS. 2 and 3, the opposite ends of which are rotatably received in bearing holes 38, shown in the near side plate 18 of FIG. 3. Each set of the gear trains 34 includes a combination gear 39 and pinion 40, the gear meshing with the pinions 32 of the flywheel 30 and the pinions 40 meshing with and normally driving a throw-out gear 42, to which a pinion 44 is connected for driving engagement with an additional gear 46, which respectively are fixed to the axles 22.

The throw-out gears 42 and the pinions 44 thereon are mounted upon shafts 48, which extend between the sides 18 of the frame 16 and respectively project through slots 50 and 52, the slots 50 extending substantially vertically, as seen in FIGS. 2 and 3, while the slots 52 extend substantially at about 45° to the vertical, but both sets of slots are for the same purpose, namely, to permit the throw-out gears 42 of each set to be moved out of engagement with the pinions 40 on the gears 38, when, for example, any of the wheels 24 contact a surface which stops rotation thereof while the inertia flywheel 30 continues to revolve.

Referring to FIG. 2, the throw-out gears 42 are in driving engagement with the other gears of each of the trains 34, which, in FIG. 3, are bracketed with said reference numeral, when the shafts 48 are in the ends of the slots, as shown in FIG. 2. They are yeildably maintained in such ends of the slots by spring means comprising a very simple, substantially straight spring wire 54, said springs preferably being mounted on the outer surface of each of the sides 18 and are maintained in operative position therealong by clips 56 struck from the sheet metal of said side.

When any of the wheels 24 engage a surface which prevents rotation thereof, however, the axle affixed to said wheel or wheels stops rotating which, in turn, stops rotation of the gears 46 fixed to said axles. When this occurs, the continuous rotation of the flywheel 30 and the gears 38 in mesh with the pinions 32 thereon will continue to rotate, and the pinions 40 on the gears 38 which mesh with the throw-out gears 42, will rotate said throw-out gears a short distance by the pinions 44 moving a short way along the gears 46, which movement is permitted by the shafts 48 moving toward the opposite ends of the slots 50 against the action of the springs 54, which engage the ends of the shafts 48. In view of the foregoing, no positive driving meshing will occur between the throw-out gears 42 and the pinions 40 on gears 38, even though the gears 38 and their pinions 40 continue to revolve, the teeth on the pinions 40 will rub over the teeth on the gears 42, but not mesh therewith and thereby prevent any serious damage to the gears of the various trains. As soon, however, as the wheels 24 are moved from contact with an obstructing surface that stops the rotation thereof, the springs 54 will instantly move the shafts 48 toward the operative ends of the slots 50 within which they are disposed, and thereby, re-engage in meshing relationship the teeth of the throw-out gears 42 with the pinions 40 and continued rotation of the flywheel 30 will restore driving movement to the wheels 24.

From the foregoing, it will be seen that a relatively simple and straightforward design of gear arrangement operated by an inertia-type flywheel is provided and includes safety means of a simple and effective nature, which is inexpensive to manufacture and reliable to disrupt meshing engagement of the throw-out gears with the pinions that drive the same in each train when any or all of the wheels 24 of the vehicle engage an abutting surface which stops rotation thereof.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy wheeled vehicle comprising in combination, an elongated chassis, having a pair of parallel side plates, a pair of parallel axles extending transversely through bearing holes in said side plates of said chassis and spaced longitudinally therealong adjacent opposite ends of said chassis, pairs of wheels affixed respectively to opposite ends of both said axles, and a motor mounted on said chassis which comprises an inertia type flywheel supported on a shaft intermediately between said axles in bearing holes in said side plates and interengaging gear trains mounted respectively between the shaft of said fly-wheel and both axles to produce a unidirectional four-wheel drive for said vehicle, the improvement comprising mounting the gears of said trains upon shafts extending between bearing holes in said side plates disposed substantially along straight lines between the bearing holes for the axles of said wheels and shaft of said flywheel, and including in each of said gear trains, gear throw-out mechanism operable upon one gear of each train automatically to disengage the same from driving connection with other gears in said trains when any of said wheels are stopped from rotating while said flywheel is still rotating and thereby prevent injury to said gear trains, said throw-out mechanism comprising opposite pairs of short slots in said side plates of said chassis supporting the shafts of said one gear of each train, the slots for the shafts of the said throw-out gears being at angles to each other respectively in said side plates.

2. The toy wheeled vehicle according to claim 1 further including substantially straight wire spring members supporting respectively by said frame plates and the opposite end portions of said springs engaging respectively with said ends of said shafts disposed in said slots and operable normally to retain said ends of said shafts in positions in said slots in which said gears on said shafts are in driving engagement with the other gears of said trains but said spring means being yieldable when said wheels air stopped while said flywheel is still rotating to permit said gears on said shafts in said slots to move out of driving engagement with said trains as aforesaid, and supports on said side plates intermediately of the ends of said wire spring members supporting the same with the opposite ends being freely flexible for engagement with said ends of said shafts.

* * * * *